US005576280A

United States Patent [19]

Chopra et al.

[11] Patent Number: 5,576,280

[45] Date of Patent: Nov. 19, 1996

[54] SOLID PERSONAL CLEANSING COMPOSITION COMPRISING A PRECOMPLEX OF CATIONIC SURFACTANTS AND ANIONIC MATERIALS

[75] Inventors: Suman K. Chopra, Dayton; Teresa R. Carale, Princeton; Amrit Patel, Dayton, all of N.J.

[73] Assignee: Colgate-Palmolive Company, New York, N.Y.

[21] Appl. No.: 327,158

[22] Filed: Oct. 21, 1994

[51] Int. Cl.[6] ..... C11D 1/65; C11D 1/86; C11D 17/00

[52] U.S. Cl. ..... 510/155; 510/130; 510/141; 510/156; 510/447

[58] Field of Search ..... 252/DIG. 5, DIG. 16, 252/547, 550, 552, 117, 174

[56] References Cited

U.S. PATENT DOCUMENTS

| | | | |
|---|---|---|---|
| 3,903,008 | 9/1975 | DeWeever et al. | 252/118 |
| 3,954,679 | 5/1976 | Wixon | 252/555 |
| 4,076,800 | 2/1978 | Marsh et al. | 424/70 |
| 4,109,010 | 8/1978 | Sias | 424/289 |
| 4,195,077 | 3/1980 | Marsh et al. | 424/70 |
| 4,208,402 | 6/1980 | Bore et al. | 424/70 |
| 4,303,543 | 12/1981 | Mansy | 252/117 |
| 4,438,024 | 3/1984 | DelGreco | 252/545 |
| 4,488,981 | 12/1984 | Urfer et al. | 252/174.17 |
| 4,751,009 | 6/1988 | Damaso | 252/8.75 |
| 4,844,824 | 7/1989 | Mermelstein | 252/8.75 |
| 4,882,076 | 11/1989 | Kern | 252/8.8 |
| 4,888,119 | 12/1989 | Klewsaat | 252/8.75 |
| 4,913,828 | 4/1990 | Caswell | 252/88 |
| 4,986,927 | 1/1991 | Elton | 252/118 |
| 5,041,239 | 8/1991 | Rorig | 252/315.1 |
| 5,078,896 | 1/1992 | Rorig | 252/102 |
| 5,202,048 | 4/1993 | Bartolo et al. | 252/117 |
| 5,204,010 | 4/1993 | Klewsaat | 252/8.75 |
| 5,227,086 | 6/1993 | Kachem et al. | 252/112 |
| 5,233,179 | 6/1993 | Connor et al. | 252/548 |
| 5,294,364 | 3/1994 | Thomas et al. | 252/142 |
| 5,296,159 | 3/1994 | Wilson et al. | 252/117 |
| 5,300,249 | 4/1994 | Schwartz et al. | 252/108 |
| 5,308,526 | 5/1994 | Dias et al. | 252/125 |
| 5,312,559 | 5/1994 | Kacher et al. | 252/125 |
| 5,328,632 | 6/1994 | Redd et al. | 252/174 |
| 5,340,492 | 8/1994 | Kacher et al. | 252/112 |
| 5,382,386 | 1/1995 | Jakubicki | 252/548 |
| 5,387,362 | 2/1995 | Tollens et al. | 252/108 |
| 5,466,396 | 11/1995 | Madison | 252/557 |

FOREIGN PATENT DOCUMENTS

| | | |
|---|---|---|
| 0015032 | 9/1980 | European Pat. Off. . |
| 0294892 | 12/1988 | European Pat. Off. . |
| 1050791 | 12/1966 | United Kingdom . |

*Primary Examiner*—Douglas J. McGinty
*Assistant Examiner*—Gregory R. Delcotto
*Attorney, Agent, or Firm*—Martin B. Barancik; James M. Serafino

[57] ABSTRACT

A solid personal cleansing composition comprising:

a. one or more cationic surfactants complexed with one or more anionic surfactants and b. one or more non complexed anionic surfactants.

11 Claims, No Drawings

SOLID PERSONAL CLEANSING COMPOSITION COMPRISING A PRECOMPLEX OF CATIONIC SURFACTANTS AND ANIONIC MATERIALS

BACKGROUND OF THE INVENTION

Throughout the years there have been continuing methods of improving the mildness, physical characteristics, foam, conditioning effects and other properties of personal cleansing compositions, particularly in the solid, for example bar or cake, form. A new approach to improving these properties, particularly the structural properties of a solid composition for example the properties of bar hardness, slough and use-up has now been discovered.

In the past there have been complexes made between soap and cationic polymers in order to increase the mildness of the solid composition see WO 93/06205. However in that patent application, there is nothing mentioned about any positive attributes that such a complex may provide to the finished solid composition. It is only stated that there is equivalent "tightness" when the complex of the cationic polymer with soap is present in comparison to the solid composition bar when there is no complex present. Furthermore the document states that such complex between the soap and the cationic polymer does not adversely affect bar smear, wear rate, lather, or rinsing profile. When the cationic polymer was provided alone to the bar composition as opposed to present in a complexed state with the soap, the bar demonstrated significant reduction in dryness and redness compared to the bar without cationic polymer. However the bar had a significant increase in tightness.

BRIEF SUMMARY OF THE INVENTION

In accordance with the invention there is a solid personal cleansing composition comprising:

a. one or more cationic surfactants complexed with one or more anionic surfactants and b. one or more non complexed anionic surfactant.

DETAILED DESCRIPTION OF THE INVENTION

It has now been found that the formation of a complex between a cationic surfactant and an anionic surfactant brings about increased structural attributes to a solid personal cleansing composition. The presence of such complex increases the hardness of the bar. This is particularly useful where there are anionic surfactants which can soften a bar and make it more difficult to process, such as sodium cocoylisethionate (SCI). The presence of the complex also reduces slough and use-up. Additionally, conditioning and moisturizing effects can be observed as well as lather enhancement when the complex of cationic surfactant and anionic surfactant is present in the solid cleansing composition.

Anionic surfactants which can form the complex with the cationic surfactant include soaps, i.e. long chain alkyl carboxylate salts, sulfonates, alkylaromatic such as dodecylbenzene sulfonate, secondary alkyl sulfonates, alpha olefin sulfonates, alkyl glyceryl ether sulfonates, primary and secondary alkyl sulfates, alkyl ether sulfates, fatty acid amide sulfonates, phosphates, taurates, sulfosuccinates, isethionates, such as sodium cocoyl isethionates (SCI) and the like. Many of these anionic surfactants can be alkoxylated preferably ethoxylated, such as the carboxylate, sulfate, ether sulfates, sulfonates, glyceryl sulfonates and the like. Also included with the definition of anionic surfactants for the purpose of this specification and claims are anionic substances which are classified as hydrotropes. These materials are also known to remove soil from surfaces. Some of these are classified as surfactant—hydrotrope in the Cosmetic Toiletry Fragrance Association, International Cosmetic Ingredient Dictionary (CTFA), for example the salt of cumene sulfonate, i.e. sodium salt. Other examples of such hydrotropic materials are xylene sulfonates, toluene sulfonate and substituted carboxylated cocoimidazoline organophosphate, available as Phosphoteric P-C6 from Mona Industries.

Particular anionic surfactants which can be complexed are soaps, sulfonates such as alkyl glyceryl ether sulfonates, ethoxylated or not, sodium cocoyl isethionate (SCI), sodium cocoylmonoglyceryl sulfonate (CMGS), sodium lauryl sulfate, ethoxylated or not, sodium cumene sulfonate, ethoxylated or not, and the like.

Cationic surfactants which can be employed include ammonium salts such as distearyldimethylammonium chloride, halide salts of methylated ammonium wherein at least one and preferably two or three of the groups on the nitrogen are long chain substantially saturated material such as tallow fatty radicals, hydrogenated tallow fatty radicals, methosulfate anionic salts of the above, long chain amidoderivative such as mink oil amidopropyldimethyl-2-hydroxyethylammonium chloride (Quaternium 26), aromatics such as isododecylbenzyl triethanol ammonium chloride, N-alkylated amphoteric materials such as N-alkylated betaines. Further cationic surfactants can include alkylamines, alkylimidazolines, various ethoxylated amines and the like. Examples of such cationic surfactants as noted in the CTFA include Quaternium –8, –14, –18, –24, –26, –27, –33, –43, –52, –53, –60, –62, –83 and the like. Cationic surfactants which are monomeric as opposed to polymeric are preferred. The presence of multiple alkoxy groups does not make a monomeric cationic surfactant a polymeric material for purposes of the specification and claims.

A designed procedure to bring about the complexing of cationic surfactant and anionic surfactant is required. For example, the cationic surfactant and anionic surfactant desired to be complexed can be mixed together in the presence of water in a Ross mixer at an elevated temperature for 15 to 30 minutes. The remainder of the anionic surfactant is then added and the admixture stirred at elevated temperature. Soap, if present in the final formulation and not already complexed can then be added and the mass further mixed. The mixture can then be flaked on a chill roll mill. Those flakes or chips can then be made into a personal cleansing composition by standard methods such as mixing with other ingredients in an amalgamator. For example, the chips are milled, plodded and pressed into soap bars. Therefore it is clear that the complex of the invention is made separately from the ordinary solid cleansing composition manufacturing process and is present in the final composition as a preformed complex.

The quantity of complex, or precomplex, which can be interchangeably used throughout the specification and claims for complex, showing that it is purposefully made, is present up to about 25 mole percent of the anionic surfactant present. Little advantageous behavior is seen for having more than about 25 mole % of the anionic surfactant complexed with the cationic surfactant. Generally at least 0.2 mole % of the anionic surfactant should be complexed to observe beneficial effects. Preferably above 1 mole % of the anionic surfactant present should be complexed with the cationic surfactant. A range of about 2 to about 15 mole % of the anionic surfactant is preferably complexed with the cationic surfactant, more preferably up to about 10 or 5 mole % maximum Generally, the complex formation occurs on a one to one molar basis.

Other materials commonly found in personal cleansing solid compositions can be present. For example nonionic surfactants such as long chain ethanolamine, amides and alkyl polyglycosides can also be present in the composition. Various preservatives, chelating agents, antibacterial agents, pigments, dyes, fragrances, free fatty acids, extra cationic surfactants and the like can also be present in the solid compositions. They may be added at their usual position in the manufacturing process. The amount of moisture is not unduly significant and can vary from that generally found in soaps to that found in syndets or combars, generally from about 2 to 16 wt %, preferably from about 4 to 12 wt %.

Generally all types of solid personal cleansing compositions are within the broad concept and application of this invention. The anionic surfactants can vary from about 1 to 99 wt % of the solid composition, taking into account the portion of complex which is anionic surfactant as well. Soap i.e. long chain carboxylate salt need not be present at all but it is preferred to have at least 5 wt % soap, preferably 10 or 15 wt % soap. A particularly preferred composition has about 10 to 30 wt % soap and about 40 to 70 wt % other anionic surfactants such as alkylisethionate having about 12 to 18 carbon atoms together with about 1 to 20 wt % free fatty acids. Another preferred composition has about 6 to 25 wt % of anionic surfactant other than soap such as alkylisethionate or alkylglycerylethersulfonate, ethoxylated or not, and about 50 to 75 wt % of soap together with about 1 to 20 wt % of free fatty acids.

It should be noted that the complex prepared can have mixtures of cationic surfactants and/or anionic surfactants therein.

As stated previously the presence of these complexes bring about greater structural integrity as measured by at least one of hardness, slough and use-up. It also brings about better skin feel, i.e. moisturization, and/or conditioning, and/or lathering.

Below are procedures to prepare the complex of the cationic surfactant and anionic surfactant as well as formulations having such complexes therein and comparison testing to control formulations without complex.

1. Preparation of complex.

Distearyldimethylammonium chloride was mixed with the anionic surfactant to be complexed (for example soap, SCI, sodium cumene sulfonate and the like) in an equimolar amount in the presence of water for a period of 15–30 minutes in a Ross mixer at 100°–110° C. The cationic and anionic surfactant complex made by this process were studied by differential scanning calorimetry (DSC). These complexes have different melting points/softening points than the individual starting materials.

2. Preparation of bar. Following the premixing described above the remainder of the SCI, soap (85/15, tallow/coco) or sodium cumene sulfonate that was not complexed according to the formulations, provided below are mixed for an additional hour at 100°–110° C. The additional anionic surfactant(s) were then added to the mixer in accordance with the formulations shown below and mixed for an additional 30–45 minutes at 100°–100° C. The final mixture was then flaked on a chill roll mill. These chips were then mixed with the other ingredients of the formulations below in the amalgamator. The chips were twice milled, plodded and pressed into soap bars. All the example soap bars were opaque.

TABLE I

| Formula: | Control | Example 1a | Example 2b |
|---|---|---|---|
| SCI | 49% | 49% | 49% |
| soap (85/15) | 15% | 15% | 15% |
| Water | 6.5% | 6.5% | 6.5% |
| Stearic Acid | 27% | 25% | 25% |
| TA 100 | 0.00 | 3% | 3% |
| Miscellaneous (Preservative, fragrance, etc.) | q.s. | q.s. | q.s. |
| Water q.s. | | | |

TA 100 = distearyldimethylam-monium chloride
SCI = sodium cocoyl isethionate
a. SCI/TA 100 complex is present utilizing the TA 100 present.
b. soap/TA 100 complex is present utilizing the TA 100 present.

The formulations of Table I were tested for hardness, slough and use-up by the following methods.

Hardness: The bar hardness was determined using the needle penetrometer. The apparatus uses a weighted needle point, and the depth of penetration into the soap surface was measured for a 10-second interval. A minimum of nine data points were taken, and average results are given in millimeters. The results provide a relative assessment of bar hardness.

Slough Test (high humidity): The weight of the bar was recorded in grams. The bars were washed twice at 30 minute intervals for 10 seconds at 100° F. before testing. The bar was placed in a soap dish (120 mm×75 mm×16 mm). The dish was filled with tap water, and the bar remained in the water for 17 hours at 35°–40° C. at 100% relative humidity. At the end of 17 hours, the resulting soft material (slough) was removed using finger pressure. The bar was air-dried for 24 hours at 21°–25° C., after which the bar weight was recorded. The weight loss was determined as the loss in grams.

Slough Test (low humidity, room temperature)—The initial weights of the soap bars were recorded. The bars were placed in plastic soap dishes (120 mm×75 mm×16 mm) filled with tap water at room temperature. The soap remained in the water for 17 hours. The soft soap was then removed by hand, and the bars were dried at room temperature for 24 hours and weighed. The test results are given as the weight loss in grams.

Use-Up: In this method, the soap bars were repeatedly washed and then allowed to dry. The test was carried out over a 4-day period in order to simulate at-home usage. The initial weights of the bars were recorded. A few different individuals washed the bars for 10-second intervals in warm tap water (90°–100° F.). The soap bars were placed in a soap dish with a grid to allow drainage of water. The bars were allowed to dry for at least a 20-minute interval between washings. The soap bars underwent a total of 20 washes of 10-second duration, and were then dried for 24 hours prior to reweighing. The results were reported as weight loss per 100 grams. Below are the results:

| | Control | Example 1a | Example 2b |
|---|---|---|---|
| Hardness (mm) | 4.04 | 3.65 | 2.84 |
| Slough, grams (high humidity) | 24.1 | 20.4 | 22.6 |
| Slough, grams (slow humidity) | 10.5 | 9.2 | 9.5 |
| Use-up (%) | 33.9 | 26.7 | 29.5 |

The same procedures as shown above were used to prepare bars having a 1:1 molar complex of sodium cumene sulfonate with distearyldimethylammonium chloride (example 3) or tricetylmethylammonium chloride (example 4). The cationic surfactants were present in sufficient quantities to complex the sodium cumene sulfonates on a 1:1 molar basis to make 3 wt % of the final composition. To the complex was added as in preparation 2, soap chips with moisture, the soap chips having a content of 60 wt % tallow soap, 40 wt %, coco soap and 7 wt % free fatty acid with the exception that the mixing occurred in an amalgamator. The mixture was stirred and heated at 100°–110° C. for a period of 15 minutes, milled, plodded and pressed into bars having a final composition of 87 wt % soap chips (60/40/7), 3 wt% 1:1 cationic polymer sodium cumene sulfonate complex and 10 wt % moisture. A control bar was made in the same manner but with no complex and having 90 wt % soap chip and 10 wt % moisture. Below are the results:

| Bar | Harness (mm) | Slough, grams (high humidity) | Conditioning |
|---|---|---|---|
| Control | 4.13 | 15.0% | 3 |
| Example 3 | 3.4 | 12.2% | 8 |
| Example 4 | 3.5 | 11.6% | 8 |

The conditioning effects of the soap bar were evaluated by different individuals who washed their hands with the subject matter bars.

The conditioning effects were evaluated on a scale of 1–10. 1 is the lowest conditioning and 10 is the highest conditioning.

The invention bars had very little or no perceptible drag on the skin.

We claim:

1. A solid personal cleansing composition comprising a. one or more cationic surfactant precomplexed with one or more anionic hydrotropes and b. one or more non complexed anionic materials selected from the group consisting of anionic surfactants and anionic hydrotropes wherein no more than about 25 mole % of total anionic materials present in the composition is precomplexed and the anionic material is from about 1 to 99 wt % of the composition.

2. The composition in accordance with claim 1 wherein the precomplex of cationic surfactant and anionic hydrotrope has a different melting point/softening point than the non precomplexed cationic surfactant and non precomplexed anionic hydrotrope as measured by differential scanning calorimetry.

3. A solid personal cleansing composition comprising a. one or more cationic surfactant precomplexed with one or more anionic hydrotropes and b. one or more non complexed anionic materials selected from the group consisting of anionic surfactants and anionic hydrotropes wherein no more than about 25 mole % of total anionic materials present in the composition is precomplexed and at least about 5 wt. % of the composition is soap.

4. The composition in accordance with claim 1 wherein the hydrotrope is selected from the group consisting of cumene sulfonate, xylene sulfonates, and toluene sulfonate.

5. The composition in accordance with claim 3 wherein the hydrotrope is selected from the group consisting of cumene sulfonate, xylene sulfonates, and toluene sulfonate.

6. The composition in accordance with claim 1 wherein the anionic surfactant is selected from the salt of a group consisting of carboxylates, sulfates, sulfonates, ether sulfates, phosphates, taurates, sulfosuccinates and isethionates.

7. The composition in accordance with claim 1 wherein the cationic surfactant is an ammonium compound.

8. The composition in accordance with claim 1 wherein the precomplex is preformed by contacting approximately equimolar amounts of the cationic material with the anionic hydrotrope.

9. The composition in accordance with claim 3 wherein the precomplex is preformed by contacting approximately equimolar amounts of the cationic hydrotrope with the hydrotrope.

10. A method for cleansing the skin which comprises applying to the skin the composition of claim 1.

11. A method for cleansing the skin which comprises applying to the skin the composition of claim 3.

* * * * *